US005665017A

United States Patent [19]

Walters

[11] Patent Number: 5,665,017

[45] Date of Patent: Sep. 9, 1997

[54] TETHER BALL SAFETY COVER

[76] Inventor: John D. Walters, 18656 Marimba St., Rowland Hts., Calif. 91748

[21] Appl. No.: 671,003

[22] Filed: Jun. 28, 1996

[51] Int. Cl.[6] ..... A63B 67/10

[52] U.S. Cl. ..... 473/573; 473/575

[58] Field of Search ..... 273/58 C, 413, 273/414, DIG. 30; 473/423, 573, 575, 576

[56] References Cited

U.S. PATENT DOCUMENTS

| | | | |
|---|---|---|---|
| D. 332,350 | 1/1993 | Anderson | D3/104 |
| 4,147,353 | 4/1979 | Moore | 273/413 |
| 4,161,313 | 7/1979 | Dickey | 273/DIG. 30 X |
| 4,272,076 | 6/1981 | Song et al. | 273/58 C |
| 5,083,797 | 1/1992 | Vartija et al. | 273/414 |
| 5,094,462 | 3/1992 | Boyle et al. | 273/414 |
| 5,294,112 | 3/1994 | Smith | 273/58 BA |

FOREIGN PATENT DOCUMENTS

| | | | |
|---|---|---|---|
| 2107995 | 5/1983 | United Kingdom | 273/414 |

*Primary Examiner*—William H. Grieb

[57] ABSTRACT

A new Tether Ball Safety Cover for offering a tether ball cover to prevent injury caused by contact with the tether ball eye loop or rope retaining knot. The inventive device includes a tether ball, a conical shaped protector, inner Velcro strips, and outer Velcro strips. In use, referring to FIGS. 5 and 6, the conical shaped protector 14 is slid onto the rope 16. Then the rope 16 is threaded through the tether ball eye loop 40 and the rope retaining knot 18 is tied into the end of the rope 16 to prevent the rope 16 from slipping back through the tether ball eye loop 40. Lastly, the conical shaped protector 14 is slid down to engage the tether ball 12, mating inner Velcro strips 28 with outer Velcro strips 26, thereby removably holding the assembly together and therefore providing a shield to prevent injury causing contact with the tether ball eye loop 40 or the rope retaining knot 18.

6 Claims, 3 Drawing Sheets

TETHER BALL SAFETY COVER

BACKGROUND OF THE INVENTION

1. Field of the Invention

The present invention relates to tether ball games and more particularly pertains to a new Tether Ball Safety Cover for offering a tether ball cover to prevent injury caused by contact with the tether ball eye loop or rope retaining knot.

2. Description of the Prior Art

The use of tether ball games is known in the prior art. More specifically, tether ball games heretofore devised and utilized are known to consist basically of familiar, expected and obvious structural configurations, notwithstanding the myriad of designs encompassed by the crowded prior art which have been developed for the fulfillment of countless objectives and requirements.

Known prior art tether ball games include. U.S. Pat. No. 4,147,353; U.S. Pat. No. 4,272,076; U.S. Pat. No. Des. 332,350; U.S. Pat. No. 5,083,797; and U.S. Pat. No. 5,094,462.

While these devices fulfill their respective, particular objectives and requirements, the aforementioned patents do not disclose a new Tether Ball Safety Cover. The inventive device includes a tether ball, a conical shaped protector, inner Velcro strips, and outer Velcro strips.

In these respects, the Tether Ball Safety Cover according to the present invention substantially departs from the conventional concepts and designs of the prior art, and in so doing provides an apparatus primarily developed for the purpose of offering a tether ball cover to prevent injury caused by contact with the tether ball eye loop or rope retaining knot.

SUMMARY OF THE INVENTION

In view of the foregoing disadvantages inherent in the known types of tether ball games now present in the prior art, the present invention provides a new Tether Ball Safety Cover construction wherein the same can be utilized for offering a tether ball cover to prevent injury caused by contact with the tether ball eye loop or rope retaining knot.

The general purpose of the present invention, which will be described subsequently in greater detail, is to provide a new Tether Ball Safety Cover apparatus and method which has many of the advantages of the tether ball games mentioned heretofore and many novel features that result in a new Tether Ball Safety Cover which is not anticipated, rendered obvious, suggested, or even implied by any of the prior art tether ball games, either alone or in any combination thereof.

To attain this, the present invention generally comprises a tether ball, a conical shaped protector, inner Velcro strips, and outer Velcro strips.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, not is it intended to be limiting as to the scope of the invention in any way.

It is therefore an object of the present invention to provide a new Tether Ball Safety Cover apparatus and method which has many of the advantages of the tether ball games mentioned heretofore and many novel features that result in a new Tether Ball Safety Cover which is not anticipated, rendered obvious, suggested, or even implied by any of the prior art tether ball games, either alone or in any combination thereof.

It is another object of the present invention to provide a new Tether Ball Safety Cover which may be easily and efficiently manufactured and marketed.

It is a further object of the present invention to provide a new Tether Ball Safety Cover which is of a durable and reliable construction.

An even further object of the present invention is to provide a new Tether Ball Safety Cover which is susceptible of a low cost of manufacture with regard to both materials and labor, and which accordingly is then susceptible of low prices of sale to the consuming public, thereby making such Tether Ball Safety Cover economically available to the buying public.

Still yet another object of the present invention is to provide a new Tether Ball Safety Cover which provides in the apparatuses and methods of the prior art some of the advantages thereof, while simultaneously overcoming some of the disadvantages notmally associated therewith.

Still another object of the present invention is to provide a new Tether Ball Safety Cover for offering a tether ball cover to prevent injury caused by contact with the tether ball eye loop or rope retaining knot.

Yet another object of the present invention is to provide a new Tether Ball Safety Cover which includes a tether ball, a conical shaped protector, inner Velcro strips, and outer Velcro strips.

Still yet another object of the present invention is to provide a new Tether Ball Safety Cover that secures the tether ball to the protective conical shaped protector.

Even still another object of the present invention is to provide a new Tether Ball Safety Cover that does not negate any facet of a tether ball game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
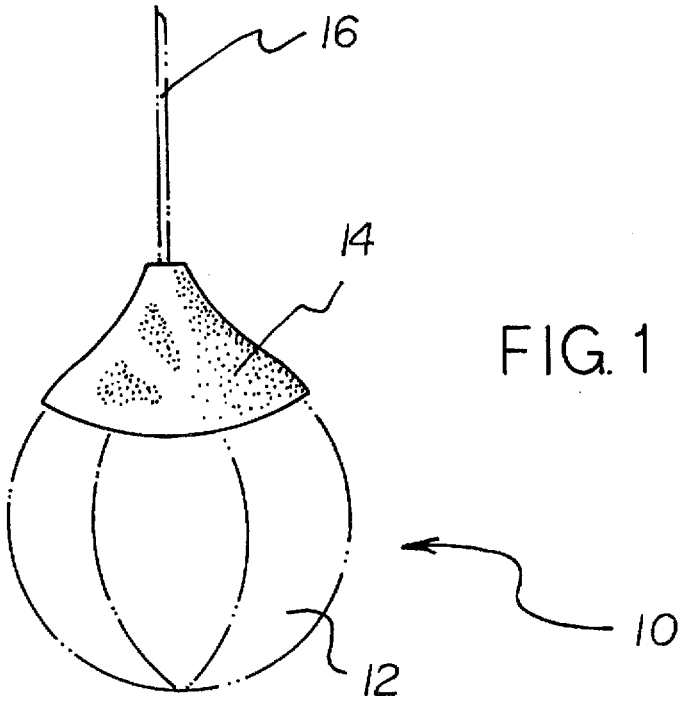
FIG. 1 is a front side perspective view of a new Tether Ball Safety Cover in use according to the present invention.
Figure 2:
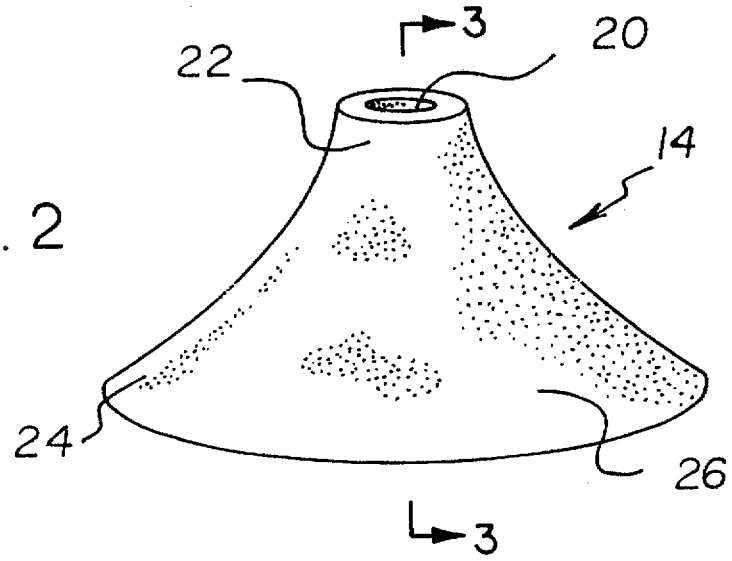
FIG. 2 is a front side perspective view of a new Tether Ball Safety Cover according to the present invention.

With reference now to the drawings, and in particular to FIGS. 1 through 6 thereof, a new Tether Ball Safety Cover embodying the principles and concepts of the present invention and generally designated by the reference numeral 10 will be described.

More specifically, it will be noted that the Tether Ball Safety Cover 10 comprises a tether ball 12, a conical shaped protector 14, inner Velcro strips 30, and outer Velcro strips 32 where the inner Velcro strips 30 are permanently attached to the conical shaped protector 14 and the outer Velcro strips 32 are permanently attached to the tether ball 12 and the inner Velcro strips 30 and the outer Velcro strips 32 are detachably mated to each other and therefore hold the tether ball 12 and the conical shaped protector 14 together.

As best illustrated in FIGS. 1 through 6, it can be shown that the tether ball 12 is supported by a rope 16 which is treaded through a tether ball eye loop 40 and the rope 16 is terminated with a rope retaining knot 18 where the conical shaped protector 14 further comprises a rope aperture 20 which allows the rope 16 to pass through to the tether ball eye loop 40.

The rope aperture 20 is further defined as an opening that is substantially circular and is larger than an outer diameter of the rope 16 and smaller than the tether ball eye loop 40. Additionally, the size of the rope retaining knot 18 adds to the combined massive size of the tether ball eye loop 40 and aids in the prevention of the passing of the tether ball eye loop 40 through the rope aperture 20.

Figure 3:
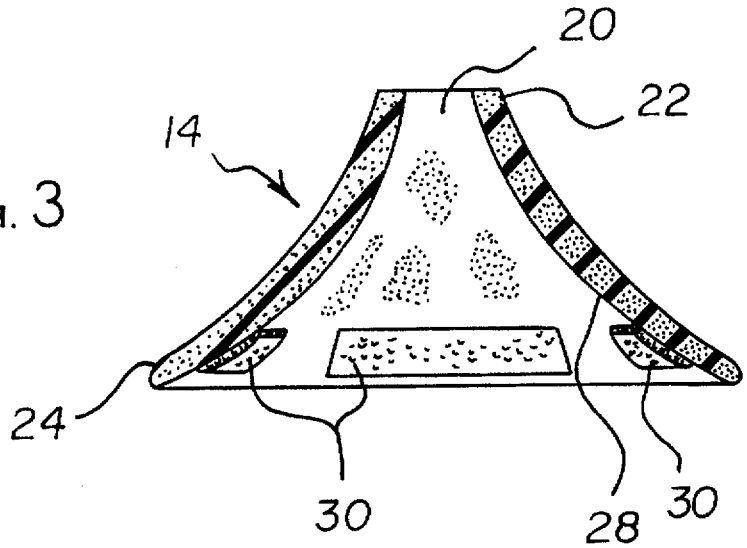
FIG. 3 is a cross sectional view taken along line 3–3 of FIG. 2.
Figure 4:
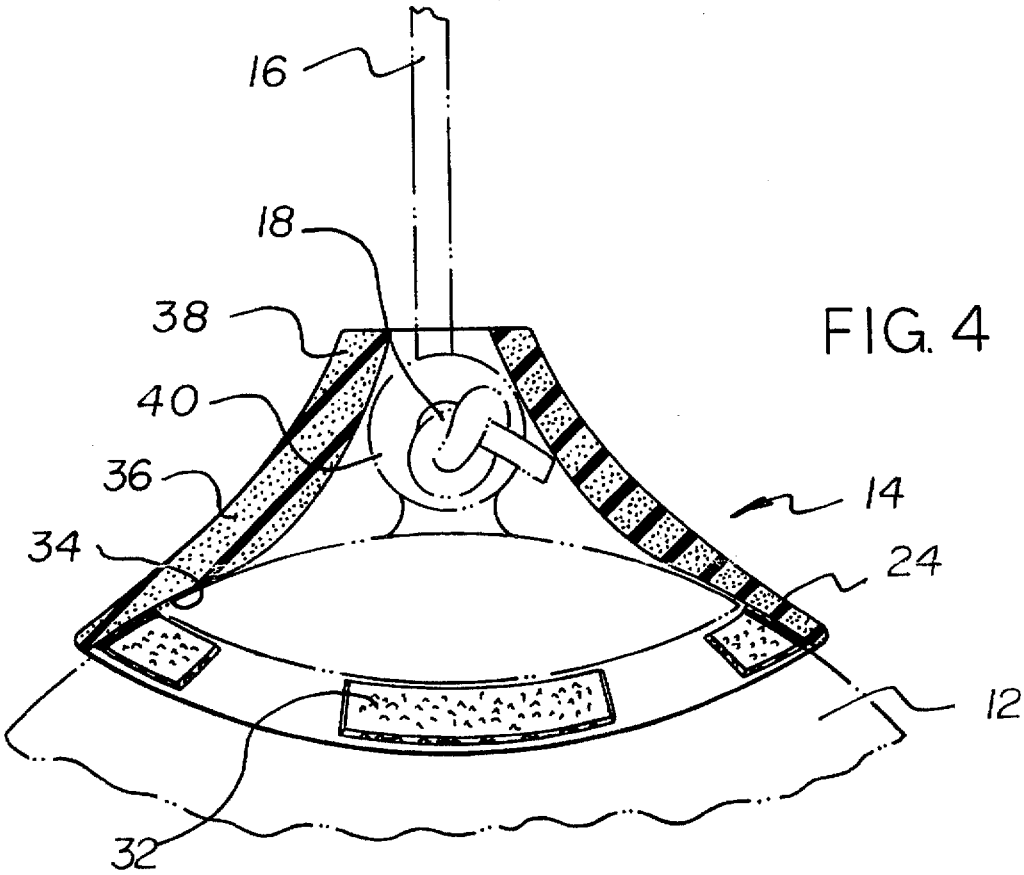
FIG. 4 is the cross sectional view of FIG. 3 with a tether ball attached.

Referring to FIGS. 3 and 4, the conical shaped protector 14 is comprised of a cone vertex 22, and a cone base 24 having an outer surface 26 and an inner surface 28 and is preferably made of a composition of rubber where the cone vertex 22 is adjacent to the rope aperture 20 and the cone base 24 is adjacent to the tether ball 12 and where the cone vertex 22 and the cone base 24 are substantially circular.

Additionally, the cone vertex 22, the rope aperture 20, the cone base 24 and the tether ball 12 are all concentric with each other, with the cone base 24 being smaller than the diameter of the tether ball 12, and receives the tether ball 12 with a portion of the tether ball 12 protruding up into the cone base 24.

The inner surface 28 is further defined as having an arcuate wall 34, a thickened wall 36, and an upper structural support wall 38 where the arcuate wall 34 defines the lower inner side of the cone base 24 and where the arcuate wall 34 possesses an arc that substantially mates with a curvature of a tether ball 12 and the upper structural support wall 38 defines the rope aperture 20 and the thickened wall 36 integrally connects the arcuate wall 34 and the upper structural support wall 38.

Figure 5:
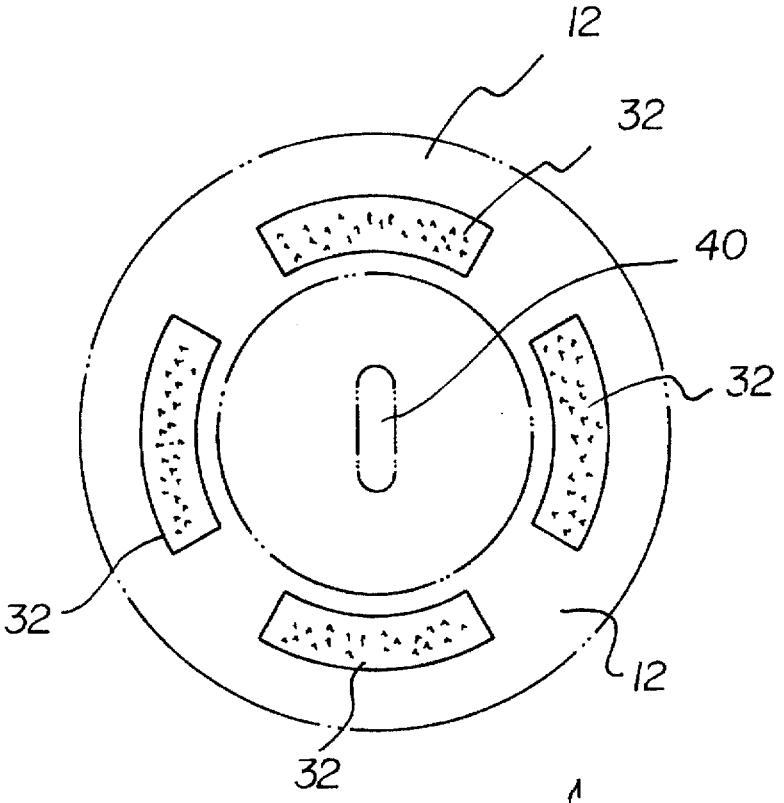
FIG. 5 is a bottom view of the invention.
Figure 6:
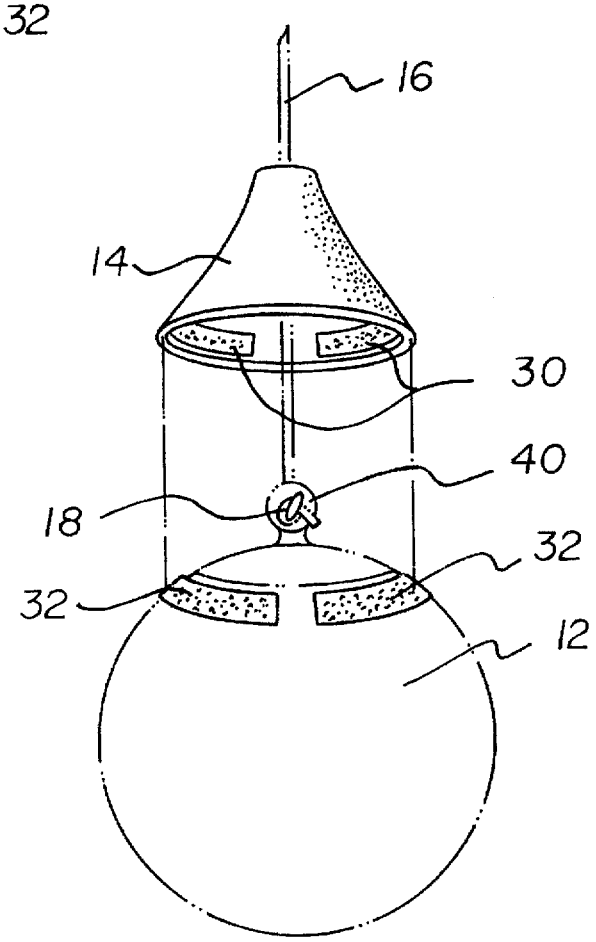
FIG. 6 is an exploded isometric illustration of the present invention.

In use, referring to FIGS. 5 and 6, the conical shaped protector 14 is slid onto the rope 16. Then the rope 16 is threaded through the tether ball eye loop 40 and the rope retaining knot 18 is tied into the end of the rope 16 to prevent the rope 16 from slipping back through the tether ball eye loop 40. Lastly, the conical shaped protector 14 is slid down to engage the tether ball 12, mating inner Velcro strips 30 with outer Velcro strips 32, thereby removably holding the assembly together and therefore providing a shield to prevent injury causing contact with the tether ball eye loop 40 or the rope retaining knot 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Tether Ball Safety Cover comprising: a tether ball, a conical shaped protector, inner Velcro strips, and outer Velcro strips where the inner Velcro strips are permanently attached to the conical shaped protector and the outer Velcro strips are permanently attached to the tether ball and the inner Velcro strips and the outer Velcro strips are detachably mated to each other and therefore hold the tether ball and the conical shaped protector together, wherein the tether ball is supported by a rope which is threaded through a tether ball eye loop and the rope is terminated with a rope retaining knot where the conical shaped protector further comprises a rope aperture which allows the rope to pass through to the tether ball eye loop.

2. The Tether Ball Safety Cover of claim 1, wherein the conical shaped protector further includes an inner surface which is further defined as having an arcuate wall, a thickened wall, and an upper structural support wall where the arcuate wall defines the lower inner side of the cone base and where the arcuate wall possesses an arc that substantially mates with a curvature of a tether ball and the upper structural support wall defines the rope aperture and the thickened wall integrally connects the arcuate wall and the upper structural support wall.

3. The Tether Ball Safety Cover of claim 2, wherein the rope aperture is further defined as an opening that is substantially circular and is larger than an outer diameter of the rope and smaller than the tether ball eye loop and where the size of the rope retaining knot adds to the combined massive size of the tether ball eye loop and aids in the prevention of the passing of the tether ball eye loop through the rope aperture.

4. The Tether Ball Safety Cover of claim 3, wherein the conical shaped protector is comprised of a cone vertex, and a cone base having an outer surface and an inner surface and is made of a composition of rubber where the cone vertex is adjacent to the rope aperture and the cone base is adjacent to the tether ball and where the cone vertex and the cone base are substantially circular.

5. The Tether Ball Safety Cover of claim 4, wherein the cone vertex, the rope aperture, the cone base and the tether ball are all concentric with each other with the cone base being smaller than the diameter of the tether ball, and receives the tether ball with a portion of the tether ball protruding up into the cone base.

6. The Tether Ball Safety Cover of claim 5, where in use the conical shaped protector is slid onto the rope and the rope is threaded through the tether ball eye loop and the rope retaining knot is tied into the end of the rope to prevent the rope from slipping back through the tether ball eye loop and the conical shaped protector is slid down to engage the tether ball mating the inner Velcro strips with the outer Velcro strips, thereby removably holding the assembly together and therefore providing a shield to prevent injury causing contact with the tether ball eye loop or the rope retaining knot.

* * * * *